US009146482B2

(12) United States Patent
Watanabe et al.

(10) Patent No.: US 9,146,482 B2
(45) Date of Patent: Sep. 29, 2015

(54) ELECTROCONDUCTIVE MEMBER FOR ELECTROPHOTOGRAPHY, PROCESS CARTRIDGE, AND ELECTROPHOTOGRAPHIC APPARATUS

(71) Applicant: CANON KABUSHIKI KAISHA, Tokyo (JP)

(72) Inventors: Masahiro Watanabe, Mishima (JP); Yuichi Kikuchi, Susono (JP); Kazuhiro Yamauchi, Suntou-gun (JP); Satoru Nishioka, Suntou-gun (JP); Norifumi Muranaka, Yokohama (JP); Mikio Shimada, Tokyo (JP); Tetsuo Hino, Yamato (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/601,951

(22) Filed: Jan. 21, 2015

(65) Prior Publication Data

US 2015/0132024 A1 May 14, 2015

Related U.S. Application Data

(63) Continuation of application No. PCT/JP2014/004919, filed on Sep. 25, 2014.

(30) Foreign Application Priority Data

Sep. 27, 2013 (JP) ..... 2013-202664

(51) Int. Cl.
*G03G 15/02* (2006.01)
*G03G 5/04* (2006.01)

(52) U.S. Cl.
CPC ..... *G03G 5/04* (2013.01); *G03G 15/0233* (2013.01)

(58) Field of Classification Search
CPC ..... G03G 5/04; G03G 15/0233
USPC ..... 399/174–176
See application file for complete search history.

(56) References Cited

U.S. PATENT DOCUMENTS

| | | | | |
|---|---|---|---|---|
| 6,212,346 | B1 * | 4/2001 | Hirabayashi et al. | 399/176 |
| 6,701,105 | B2 | 3/2004 | Funabashi | |
| 7,103,301 | B2 | 9/2006 | Watanabe et al. | |
| 2007/0092289 | A1 * | 4/2007 | Nagamori et al. | 399/100 |

FOREIGN PATENT DOCUMENTS

| | | | |
|---|---|---|---|
| JP | 9-6091 | A | 1/1997 |
| JP | 2000-19814 | A | 1/2000 |

(Continued)

OTHER PUBLICATIONS

International Search Report dated Dec. 22, 2014 in International Application No. PCT/JP2014/004919.

*Primary Examiner* — Hoang Ngo
(74) *Attorney, Agent, or Firm* — Fitzpatrick, Cella, Harper and Scinto

(57) ABSTRACT

It is an object of the present invention to provide an electroconductive member for electrophotography capable of suppressing image density unevenness caused by the adhesion of foreign matter. Provided is an electroconductive member for electrophotography, including at least: an electroconductive support, and a surface layer formed on an outer side of the electroconductive support, in which the surface layer includes a porous body, and in which the porous body satisfies the following conditions (1) to (3): (1) the porous body has a co-continuous structure including at least a skeleton that is three-dimensionally continuous and a pore that is three-dimensionally continuous; (2) the porous body has electroconductivity; and (3) an average diameter of a maximum inscribed circle of an opening of the pore on a surface of the porous body is 3 μm or more and 8 μm or less.

7 Claims, 2 Drawing Sheets

(56) References Cited

FOREIGN PATENT DOCUMENTS

| | | | |
|---|---|---|---|
| JP | 2003-66807 | A | 3/2003 |
| JP | 2004-37786 | A | 2/2004 |
| JP | 2005-115311 | A | 4/2005 |
| JP | 2010-66536 | A | 3/2010 |

* cited by examiner

ELECTROCONDUCTIVE MEMBER FOR ELECTROPHOTOGRAPHY, PROCESS CARTRIDGE, AND ELECTROPHOTOGRAPHIC APPARATUS

CROSS-REFERENCE TO RELATED APPLICATIONS

This application is a continuation of International Application No. PCT/JP2014/004919, filed Sep. 25, 2014, which claims the benefit of Japanese Patent Application No. 2013-202664, filed Sep. 27, 2013.

BACKGROUND OF THE INVENTION

1. Field of the Invention

The present invention relates to an electroconductive member for electrophotography to be used in electrophotographic apparatus such as an electrophotographic copying machine and an electrophotographic printer, and a process cartridge and electrophotographic apparatus using the electroconductive member for electrophotography.

2. Description of the Related Art

An electrophotographic image forming apparatus includes a photosensitive member serving as a member to be charged, a charging device, an exposure device, a developing device, a transfer device, and a fixing device. As the charging device, there has been widely adopted a charging device configured to charge a surface of a photosensitive member by applying a voltage to a charging member that is held in contact with or arranged closely to the surface of the photosensitive member.

In recent years, the electrophotographic image forming apparatus has output more graphic patterns due to the further advancement in colorization, with the result that there is an increasing demand for images with higher definition.

When the electrophotographic image forming apparatus is used to output high-definition images, even minute charging unevenness, which has not become a problem heretofore, may appear as density unevenness on images.

As one of the main causes for the charging unevenness, there is given the adhesion of foreign matter to a surface of the charging member during use. The foreign matter, such as a toner, an external additive, or shaved powder of a photosensitive drum, adheres to the surface of the charging member used in a contact charging method along with use so as to contaminate the surface gradually. When the foreign matter adheres to the surface of the charging member, charging unevenness occurs, with the result that streak-like or spot-like density unevenness may occur on images. Such density unevenness is recognized particularly significantly, on half-tone images. Further, such density unevenness is liable to occur particularly in a DC charging method that involves charging the photosensitive drum by applying only a DC voltage to the charging member.

In order to solve the above-mentioned problem, Japanese Patent Application Laid-Open No. 2000-19814 discloses an electroconductive member capable of being used as a charging roller, which has a minute uneven structure on a surface.

SUMMARY OF THE INVENTION

The inventors of the present invention have conducted a study by applying the electroconductive member according to Japanese Patent Application Laid-Open No. 2000-19814 to a charging roller, and have consequently confirmed the following. Although there is an effect of suppressing the adhesion of foreign matter in an initial stage of use, the surface of the charging roller wears gradually during long-term use, and the uneven structure may change to degrade the effect.

In view of the foregoing, the present invention is directed to providing an electroconductive member for electrophotography capable of suppressing image density unevenness caused by the adhesion of the foreign matter.

According to one aspect of the present invention, there is provided an electroconductive member for electrophotography, including at least: an electroconductive support; and a surface layer formed on an outer side of the electroconductive support, in which the surface layer includes a porous body, and in which the porous body satisfies the following conditions (1) to (3).

(1) The porous body has a co-continuous structure including at least a skeleton that is three-dimensionally continuous and a pore that is three-dimensionally continuous.

(2) The porous body has electroconductivity.

(3) An average diameter of a maximum inscribed circle of an opening of the pore on a surface of the porous body is 3 μm or more and 8 μm or less.

According to another aspect of the present invention, there is provided a process cartridge configured to be removably mounted onto a main body of an electrophotographic apparatus, the process cartridge including the electroconductive member for electrophotography.

According to still another aspect of the present invention, there is provided an electrophotographic apparatus, including the electroconductive member for electrophotography.

According to one aspect of the present invention, it is possible to suppress image density unevenness caused by the adhesion of the foreign matter by enhancing the ability to destaticize the foreign matter or the ability to charge the foreign matter to a polarity opposite to its original polarity.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In an electrophotographic image forming apparatus (hereinafter referred to as "electrophotographic apparatus"), a toner image is formed on a photosensitive drum through each of image forming processes including a charging process, an exposure process, and a developing process, and the toner image is transferred from the photosensitive drum onto a transfer material during a transfer process. All toner forming the toner image on the photosensitive drum is not always transferred onto the transfer material, and in particular, a toner charged to a polarity opposite to an intended polarity may remain on the photosensitive drum. An external additive of the toner, shaved powder of the photosensitive drum, and the like, as well as the toner, also remain on the photosensitive drum, but are generally scraped off with a cleaning blade that is held in abutment against the photosensitive drum.

Figure 1:
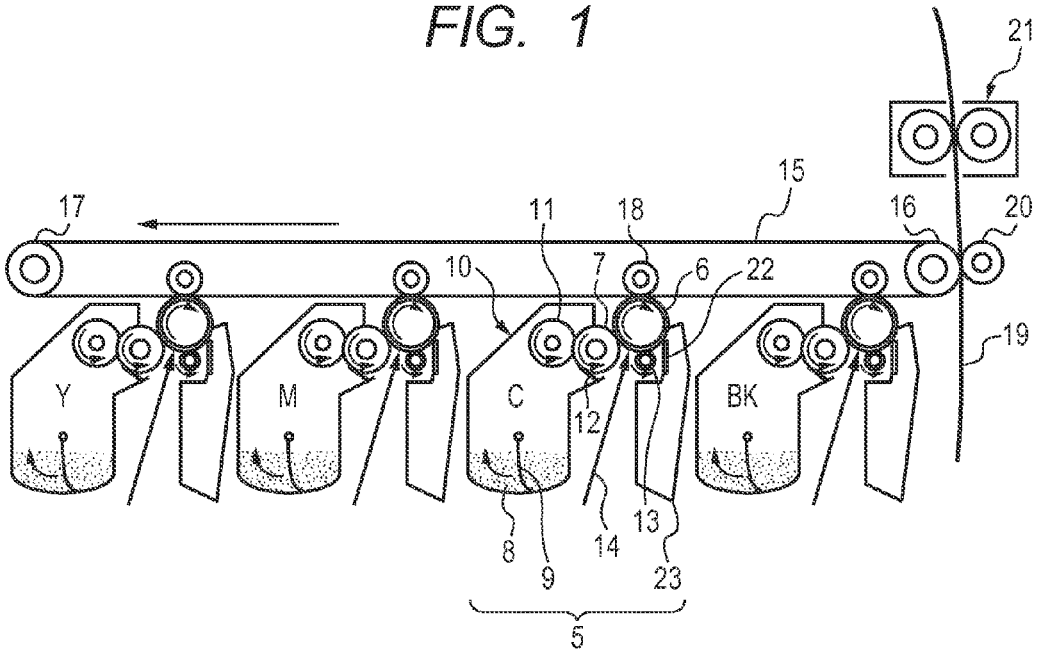
FIG. 1 is a schematic configuration view illustrating an example of an electrophotographic apparatus including an electroconductive member for electrophotography according to the present invention.

As illustrated in FIG. 1, a toner, an external additive, shaved powder of a photosensitive drum, and the like, which are scraped from a photosensitive drum 6 with a cleaning blade 22, are mixed in an edge portion of the cleaning blade to form foreign matter. However, most of the toner, external additive, shaved powder of a photosensitive drum, and the like are collected into a waste toner container (23) of a cleaning device, and hence, in general, hardly cause a problem.

However, due to the recent increase in speed and life of the electrophotographic apparatus, the amount of the foreign matter, which passes through a nip of the edge of the cleaning blade without being collected into the waste toner container of the cleaning device, is increasing. When the foreign matter, which has passed through the nip, adheres to a surface of a charging roller, density unevenness caused by charging unevenness may occur particularly in a DC charging method that involves charging the photosensitive drum by applying only a DC voltage to the charging roller.

The inventors of the present invention studied a relationship between the size of the foreign matter and the density unevenness and found the following. When the foreign matter in a thin and flat shape, which has a diameter of a maximum inscribed circle of 3 μm or more and a thickness of about 3 μm or more, adheres to a surface of an electroconductive member for electrophotography (hereinafter referred to as "electroconductive member"), the foreign matter appears as density unevenness. In particular, the foreign matter having a diameter of a maximum inscribed circle of more than 8 μm is large in amount, and hence it is important to prevent the foreign matter having a diameter of a maximum inscribed circle of more than 8 μm from adhering to the surface of the electroconductive member. Further, it was revealed that the size of the foreign matter that appears as density unevenness is almost the same, irrespective of the types of the electrophotographic apparatus and the kinds of the toner and photosensitive drums.

An aggregate formed of only the external additive is also present on the photosensitive drum besides the above-mentioned foreign matter. However, the aggregate has a small size of about tens of nm, and hence does not have an effect of causing charging unevenness even when adhering to the surface of the electroconductive member.

In general, the foreign matter adhering to the surface of the electroconductive member adheres thereto with an electrostatic force in most cases. Therefore, in order to release the adhering foreign matter, it is important to destaticize the charged foreign matter so as to make it easy to release the foreign matter from the charging roller or to charge the foreign matter to a polarity opposite to its original polarity, thereby returning the foreign matter to the photosensitive drum.

Now, the present invention is described in detail by way of preferred embodiments.

<Surface Layer>

(Co-Continuous Structure)

A surface layer according to the present invention is an electroconductive porous body having a co-continuous structure including a skeleton that is three-dimensionally continuous and a pore that is three-dimensionally continuous. In this case, the skeleton that is three-dimensionally continuous and the pore that is three-dimensionally continuous refer to a skeleton and a pore each of which has a plurality of branches and is continuous without being disconnected when viewed in a three-dimensional image of the surface layer obtained with a three-dimensional transmission electron microscope, an X-ray CT examination device, or the like.

When the surface layer is an electroconductive porous body, in the case where foreign matter adheres to an opening of the pore, a space required for discharge is ensured between a concave portion of the pore and the foreign matter, and hence discharge from a surface of an electroconductive support can reach the foreign matter through the pore. Further, in the present invention, the pore in the surface layer has no disconnected portions, and hence the discharge from the surface of the electroconductive support can reach the surface of an electroconductive member without being weakened.

As the surface layer of the electroconductive member according to the present invention is electroconductive, injection charging from the skeleton of the porous body to the foreign matter occurs. Further, discharge from the opening of the pore of the porous body occurs with respect to the foreign matter. Therefore, the electroconductive member of the present invention is excellent in destaticizing the foreign matter and charging the foreign matter to a polarity opposite to its original polarity so that the foreign matter is released easily from the electroconductive member.

(Size of Opening of Pore)

In the present invention, an average diameter of a maximum inscribed circle of the opening of the pore on the surface of the porous body is 3 μm or more and 8 μm or less. Specifically, the average diameter of the maximum inscribed circle of the opening of the pore is set to 3 μm or more so that a space required for discharge is ensured. When the average diameter of the maximum inscribed circle of the opening of the pore is less than 3 μm, in the case where the foreign matter adheres to the opening of the pore, a space required for discharge becomes small, with the result that the ability to destaticize the foreign matter and the ability to charge the foreign matter to a polarity opposite to its original polarity are degraded. Further, the average diameter of the maximum inscribed circle of the opening of the pore is set to 8 μm or less so as to prevent the foreign matter having a diameter of a maximum inscribed circle of more than 8 μm, which is large in amount in the foreign matter, from entering an inside of the pore. When the foreign matter having a diameter of a maximum inscribed circle of more than 8 μm is accumulated in the pore, a space required for discharge also becomes small, with the result that the ability to destaticize the foreign matter and the ability to charge the foreign matter to a polarity opposite to its original polarity are degraded. Although there is a risk in that the foreign matter having a diameter of a maximum inscribed circle of from 3 μm to 8 μm may enter the inside of the pore, discharge occurs also in the pore so that the foreign matter can be returned to a photosensitive drum.

Further, in the present invention, in order to form the pore that includes a plurality of branches and that is three-dimensionally continuous without being disconnected, the volume of the pore is larger than that of the skeleton in the surface layer. Therefore, when the size of the opening of the pore is within the above-mentioned range, a part of the foreign matter having a diameter of a maximum inscribed circle of more than 8 μm overlaps the opening, and thus the foreign matter is subjected to discharging from the pore as well as the injection charging so as to be released easily. On the other hand, the foreign matter having a diameter of a maximum inscribed circle of 3 μm or more and 8 μm or less may adhere to the skeleton of the porous body so as not to overlap the opening of the pore. However, the foreign matter in this range has a small charge amount and a weak electrostatic adhesion force, and hence the foreign matter can be destaticized or charged to a polarity opposite to its original polarity merely by the injection charging.

The diameter of the maximum inscribed circle of the opening of the pore is measured as follows. First, a surface of the surface layer is observed with an electron microscope so as to obtain a surface image, and the surface image is processed so as to obtain a binarized image. In this case, the pore in the actual surface layer is three-dimensionally continuous, but the opening of the pore on the surface has a closed shape. Note that, the electroconductive member is divided equally into ten regions in a longitudinal direction so that measurement points are not biased, and any one point (ten points in total) in each of the ten divided regions is defined as a measurement point, with an observation magnification being set so that at least 30 or more pores are included in the same surface image. An average diameter of a maximum inscribed circle of the opening of the pore in the binarized image at all the measurement points is determined, and the average is defined as an average diameter of a maximum inscribed circle of the opening of the pore in the present invention.

The control of the size of the opening of the pore varies depending on a method of producing the porous body having a co-continuous structure. For example, in the case of a production method using phase separation between PMMA and a mixed solution containing ethanol and water, the size of the opening of the pore increases when the molecular weight of PMMA is decreased, whereas the size of the opening of the pore decreases when the molecular weight of PMMA is increased.

(Shape of Opening of Pore)

As described above, the foreign matter that adheres to the opening of the pore is destaticized with discharge from the pore or charged to a polarity opposite to its original polarity. However, the foreign matter has insulation property, and hence only a region subjected to the discharge from the pore is destaticized or charged to an opposite polarity, with the result that the entire foreign matter cannot be destaticized or charged to an opposite polarity.

In view of the foregoing, in the present invention, the surface layer is configured to have a co-continuous structure so that the opening of the pore preferably has an asymmetric shape instead of a shape having high symmetry such as a true circle. When the opening of the pore has an asymmetric shape, a part of the foreign matter that adheres to the opening of the pore is not held in contact with an edge of the pore, and hence the foreign matter can move to the opening of another pore while rolling depending on the direction of a force applied from another member to the foreign matter. In the foreign matter that moves to the opening of another pore while rolling, a new surface is brought into contact with the opening of the pore so as to be destaticized or charged to an opposite polarity. As a result of the repetition of rolling and destaticization and charging of a new surface, the entire foreign matter can be destaticized or charged to an opposite polarity, and thus the foreign matter can be released easily or returned easily to the photosensitive drum.

The shape of the opening of the pore is preferably as complicated as possible, and the complexity of the shape of the opening of the pore can be evaluated as follows. First, measurement points and a surface image are obtained in the same way as in the case of obtaining an average diameter of a maximum inscribed circle of the opening of the pore. The opening of the pore in a binarized image is calculated for a circularity K by $L^2/4\pi S$, where L represents a perimeter of the opening of each pore, and S represents an area of the opening of the pore. The circularity K represents the complexity of the shape of the opening of the pore. When the opening of the pore has a shape of a true circle, the value of the circularity K becomes 1.0. As the shape of the opening of the pore becomes complicated, the value of the circularity K increases. An arithmetic average of the circularity K of the opening of the pore in the binarized image is determined at all the measurement points, and the average is defined as an average of the circularity K in the present invention.

When the arithmetic average of the circularity K is 2.0 or more, the foreign matter tends to roll more easily, and hence the entire foreign matter can be destaticized or charged to an opposite polarity easily.

The control of the circularity K varies depending on a method of producing the porous body having a co-continuous structure. For example, in the case of a production method using phase separation between PMMA and a mixed solution containing ethanol and water, the circularity K is decreased when the temperature for drying the mixed solvent is increased, whereas the circularity K is increased when the temperature is decreased.

(Thickness of Surface Layer)

It is preferred that the thickness of the surface layer in the present invention is 3 μm or more and 100 μm or less. It is particularly preferred that the thickness be 3 μm or more and 10 μm or less. When the thickness of the surface layer is set to 3 μm or more, a potential difference capable of causing discharge can be obtained between the surface of the electroconductive support and the surface of the surface layer. When the thickness of the surface layer is set to 100 μm or less, a distance from the electroconductive support to the foreign matter that adheres to the surface layer falls within a distance capable of being subjected to discharge.

The thickness of the surface layer can be measured by cutting a segment including the electroconductive support and the surface layer from the electroconductive member and processing and observing a cross section of the segment with an FIB-SEM device. Note that, the electroconductive member is divided equally into ten regions in a longitudinal direction so that measurement points are not biased, and any one point (ten points in total) in each of the ten divided regions is defined as a measurement point.

Although there is no particular limitation on means for controlling the thickness of the surface layer, for example, there may be given the concentration of a solid content of a coating solution in which materials for the surface layer are dissolved and the speed of coating at a time when the coating solution is applied to the electroconductive support.

(Electroconductivity of Surface Layer)

The porous body of the surface layer according to the present invention is electroconductive, and it is preferred that the volume resistivity of a material forming the porous body of the surface layer is $1\times10^3$ Ω·cm or more and less than $1\times10^{10}$ Ω·cm. When the volume resistivity of the material is set to $1\times10^3$ Ω·cm or more, a potential difference is obtained between the surface of the electroconductive support and the surface of the surface layer when a voltage is applied to the electroconductive member, and discharge from the surface of the electroconductive support to the surface of the surface layer starts. Further, when the volume resistivity of the material is set to less than $1\times10^{10}$ Ω·cm, an electric resistance value required for injection charging can be ensured. Further, it is more preferred that the volume resistivity of the material be $1\times10^4$ Ω·cm or more and $1\times10^7$ Ω·cm or less.

Note that, the volume resistivity of the porous body of the surface layer can be measured by the following method. The method involves taking a test piece not including the pore in the porous body from the porous body present on the surface of the electroconductive member according to the present invention with tweezers, bringing a cantilever of a scanning probe microscope (SPM) into contact with the test chip, and pinching the test chip between the cantilever and an electroconductive substrate. Alternatively, the volume resistivity of the porous body of the surface layer may be measured by collecting the porous body of the surface layer similarly, melting the porous body by heating or with a solvent so as to form the porous body into a sheet, and measuring the volume resistivity of the sheet.

(Material for Surface Layer)

There is no particular limitation on the material forming the porous body of the surface layer according to the present invention. An organic material such as a resin material, an inorganic material such as silica or titania, or a hybrid material of the organic material and the inorganic material may be used.

Examples of the organic material include: a polyolefin-based polymer such as polyethylene or polypropylene; a polyarylene (aromatic polymer) such as polystyrene, polyimide, polyamide, polyamide imide, poly-p-phenylene oxide, poly (2,6-dimethylphenylene oxide), or poly-p-phenylene sulfide; a polymer obtained by introducing a sulfonic acid group (—$SO_3H$), a carboxyl group (—COOH), a phosphoric acid group, a sulfonium group, an ammonium group, or a pyridinium group into a polyolefin-based polymer, polystyrene, polyimide, or a polyarylene (aromatic polymer); a fluorine-containing polymer such as polytetrafluoroethylene or polyvinylidene fluoride; a perfluorosulfonic acid polymer, a perfluorocarboxylic acid polymer, or a perfluorophosphoric acid polymer, which is obtained by introducing a sulfonic acid group, a carboxyl group, a phosphoric acid group, a sulfonium group, an ammonium group, or a pyridinium group into a skeleton of a fluorine-containing polymer; a polybutadiene-based compound; a polyurethane-based compound as an elastomer or a gel; a silicone-based compound; polyvinyl chloride; polyethylene terephthalate; nylon; and polyarylate. Note that, one kind of those polymers may be used alone, or two or more kinds thereof may be used in combination. In addition, the following polymers may be used: a polymer obtained by introducing a particular functional group into the chain of any one of those polymers and a copolymer produced from a combination of two or more kinds of monomers as raw materials for those polymers.

Examples of the inorganic material include oxides of Si, Mg, Al, Ti, Zr, V, Cr, Mn, Fe, Co, Ni, Cu, Sn, and Zn. More specific examples thereof include metal oxides such as silica, titanium oxide, aluminum oxide, alumina sol, zirconium oxide, iron oxide, and chromium oxide.

(Method of Producing Porous Body of Surface Layer)

There is no particular limitation on a method of producing the porous body of the surface layer according to the present invention as long as the porous body can be formed as the surface layer. Examples of the production method may include a method involving forming a pore through use of phase separation of a polymer material solution, a method involving forming a pore through use of a foaming agent, and a method involving forming a pore by the application of an energy line such as a laser.

As the method of producing the porous body according to the present invention, the method using phase separation of a polymer material solution is preferred because this method is effective for forming the pore and the skeleton into a fine and complicated shape. In this case, the polymer material solution refers to a solution containing a polymer material and a solvent. As the method using phase separation of a polymer material solution, for example, there may be given the following three methods.

1. A plurality of polymer materials or precursors of the polymer materials are mixed with a solvent, and the phase separation between the polymer materials is induced by changing the temperature, humidity, concentration of the solvent, compatibility between the plurality of polymer materials during polymerization of the polymer materials, and the like. Then, one of the polymer materials is removed so as to obtain a porous body in which a continuous skeleton and a continuous pore coexist. As an example, a combination of polymer materials, which are compatible with each other in a solution and become incompatible with each other after being dried, is selected. The polymer solution is applied to the electroconductive resin layer according to the present invention, and thereafter the phase separation between the polymer materials proceeds during a drying step so that a phase-separated structure is formed. After the drying, the phase-separated structure is immersed in a selective solvent capable of dissolving only one of the polymer materials. As a result of the immersion step, one of the polymer materials is eluted so as to obtain a porous structure.

2. A polymer material or a precursor of the polymer material is mixed with a solvent, and the phase separation between the polymer material and the solvent is induced by changing the temperature, humidity, concentration of the solvent, compatibility between the polymer material and the solvent during polymerization of the polymer material, and the like. Then, the solvent is removed so as to obtain a porous body in which a continuous skeleton and a continuous pore coexist.

Specifically, first, a polymer material and a solvent that are incompatible with each other at room temperature and that are compatible with each other during heating are selected. As such combinations of the polymer material and the solvent, for example, there may be given a combination of polylactic acid and dioxane and a combination of polymethyl methacrylate (PMMA) and methanol.

Then, the polymer material and the solvent are dissolved by refluxing under heating so as to obtain a coating solution, and the electroconductive support according to the present invention is immersed in the coating solution. Then, the electroconductive support is left to stand still at room temperature so that the phase separation between the polymer material and the solvent proceeds, with the result that a layer of the polymer material containing a solvent phase is formed around an electroconductive mandrel.

Finally, the solvent is removed from the layer of the polymer material so as to obtain a porous structure formed of the polymer material.

3. A polymer material, water, a solvent, a surfactant, and a polymerization initiator are mixed so as to prepare a water-in-oil-type emulsion, and the polymer material is polymerized in the oil. Then, the water is removed so as to obtain a porous body in which a continuous skeleton and a continuous pore coexist. As an example, a precursor of a polymer material is dissolved in a non-aqueous solvent, and water and a surfactant are mixed in the solution so as to prepare an emulsion solution. Next, the electroconductive resin layer according to the present invention is immersed in the emulsion solution. After the immersion, the polymer material in the emulsion solution is polymerized. After the polymerization, the water is evaporated during a drying step so as to obtain a porous structure.

Of those methods, in particular, the method 2 is an effective method compared to the other methods in miniaturizing the pore and the skeleton of the porous body because the method 2 can easily freeze a structure in an initial process of phase separation. Further, the method 2 is preferred because the method 2 makes it easy to form a complicated shape inherent to spinodal decomposition in the porous body.

(Conducting Agent of Surface Layer)

A conducting agent for adjusting an electric resistance value may be added to the porous body of the surface layer according to the present invention. As the conducting agent, an electronic conducting agent or an ionic conducting agent may be used. In particular, the ionic conducting agent that decreases the surface resistance of the surface layer is preferred from the viewpoint of injection charging.

Examples of the conducting agent include electronic conducting agents, which exhibit electronic electroconductivity, such as carbon black, graphite, an oxide (e.g. tin oxide), a metal (e.g. copper or silver), and electroconductive particles obtained by covering a particle surface with an oxide or a metal so as to impart electroconductivity to the particle surface; or ionic conducting agents having ion-exchange performance, which exhibit ionic conductivity, such as a quaternary ammonium salt and a sulfonate.

<Electroconductive Member>

Figure 2A:
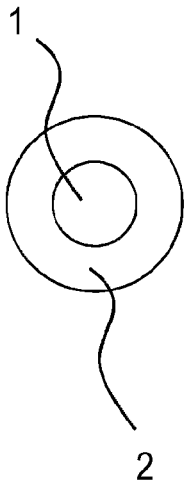
FIG. 2A is a schematic sectional view illustrating an example of the electroconductive member for electrophotography according to the present invention.
Figure 2B:
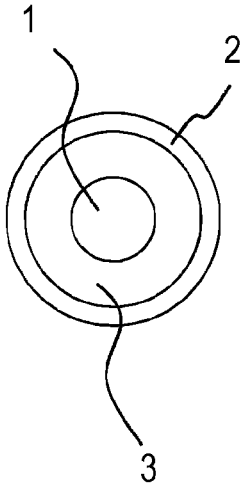
FIG. 2B is a schematic sectional view illustrating an example of the electroconductive member for electrophotography according to the present invention.
Figure 2C:
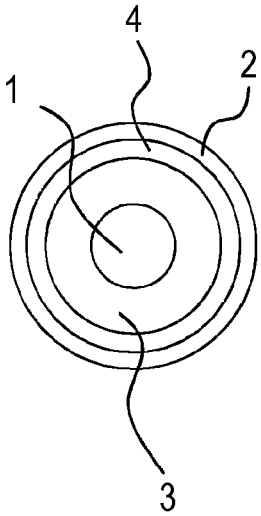
FIG. 2C is a schematic sectional view illustrating an example of the electroconductive member for electrophotography according to the present invention.

FIGS. 2A, 2B, and 2C are schematic transverse sectional views of a roller-shaped electroconductive member according to the present invention. The electroconductive member of the present invention includes at least an electroconductive support and a surface layer formed on an outer side of the electroconductive support. The electroconductive member of FIG. 2A includes an electroconductive support formed of an electroconductive mandrel 1 and a surface layer 2 formed on a surface of the electroconductive support. Further, the electroconductive member of FIG. 2B includes an electroconductive support including the electroconductive mandrel 1 and an electroconductive layer 3 formed on an outer periphery of the electroconductive mandrel 1, and the surface layer 2 formed on a surface of the electroconductive support. Note that, the electroconductive member may have a multi-layered configuration in which a plurality of electroconductive layers are arranged as needed as long as the effect of the present invention is not impaired. Further, in the present invention, an intermediate layer 4 may also be formed between the electroconductive support and the surface layer 2 as illustrated in FIG. 2C.

Further, the electroconductive member may have, instead of the roller shape, a blade shape in which a surface layer is formed on an electroconductive support formed of an electroconductive blade or on an electroconductive support having an electroconductive layer on a surface of an electroconductive blade.

(Electroconductive Support)

The electroconductive support according to the present invention may be formed of, for example, only the electroconductive mandrel 1 as illustrated in FIG. 2A. Further, as illustrated in FIG. 2B, the electroconductive support according to the present invention may be configured to have the electroconductive mandrel 1 and the electroconductive layer 3 formed on the outer periphery thereof as illustrated in FIG. 2B. Further, the electroconductive support according to the present invention may have a multi-layered configuration in which a plurality of the electroconductive layers 3 are arranged as needed as long as the effect of the present invention is not impaired.

(Electroconductive Mandrel)

As a material forming the electroconductive mandrel, materials known in the field of electroconductive members can be appropriately selected and used. For example, a solid cylindrical mandrel can be used in which a surface of a carbon steel alloy is plated with nickel having a thickness of about 5 μm.

(Electroconductive Layer)

Although there is no particular limitation on the electroconductive layer as long as the electroconductive layer can ensure a sufficient nip between a charging roller (electroconductive member) and a photosensitive drum, for example, there may be given: an epichlorohydrin rubber, a nitrile rubber (NBR), a chloroprene rubber, a urethane rubber, a silicone rubber, a styrene/butadiene/styrene (SBS) block copolymer, and a styrene/ethylenebutylene/styrene (SEBS) block copolymer. One kind of those materials may be used alone, or two or more kinds thereof may be used in combination.

The electroconductive layer preferably has a volume resistivity measured under a 23° C./50% RH environment of $1\times10^{2}$ Ω·cm or more and $1\times10^{10}$ Ω·cm or less. As a conducting agent, an electronic conducting agent or an ionic conducting agent may be used.

Examples of the electronic conducting agent include: metal-based fine particles or metal-based fibers of, for example, aluminum, palladium, iron, copper, and silver; electroconductive metal oxides such as titanium oxide, tin oxide, and zinc oxide; composite particles obtained by subjecting the surfaces of the metal-based fine particles, the metal-based fibers, or the metal oxides to surface treatment by electrolysis treatment, spray coating, or mixing and shaking; and carbon powders such as furnace black, thermal black, acetylene black, Ketjen Black, polyacrylonitrile (PAN)-based carbon, and pitch-based carbon. One kind of those agents may be used alone, or two or more kinds thereof may be used in combination.

The ionic conducting agent is not particularly limited as long as the ionic conducting agent exhibits ionic conductivity. Examples of the ionic conducting agent include: inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric surfactants such as lauryl betaine, stearyl betaine, and a dimethylalkyllauryl betaine; quaternary ammonium salts such as tetraethylammonium perchlorate, tetrabutylammonium perchlorate, and trimethyloctadecylammonium perchlorate; and organic acid lithium salts such as lithium trifluoromethanesulfonate. One kind of those agents may be used alone, or two or more kinds thereof may be used in combination.

Insulating particles or an additive for adjusting hardness such as a plasticizing oil or a plasticizer may be added to the electroconductive layer. A plasticizer of a polymer type is more preferably used as the plasticizer, and its molecular weight is preferably 2,000 or more, more preferably 4,000 or more. Further, materials for imparting various functions may each be appropriately incorporated into the electroconductive support. An age resistor and a filler can be given as examples of those materials.

The hardness of the electroconductive layer is preferably 70° or less, more preferably 60° or less when measured with a microrubber hardness meter (trade name: Model MD-1, manufactured by KOBUNSHI KEIKI CO., LTD.). When the hardness of the electroconductive layer is measured to be 70° or less with the microrubber hardness meter, the nip width between the charging roller and the photosensitive drum does not become too small, and hence the abutting force between the charging roller and the photosensitive drum can be prevented from being concentrated in a small area to increase an abutting pressure.

The electroconductive layer can be formed by attaching a sheet or a tube obtained by forming the electroconductive layer into a predetermined film thickness in advance to a mandrel or covering the mandrel with the sheet or the tube. Alternatively, the electroconductive layer can also be produced by integrally extruding the mandrel and the material for the electroconductive layer with an extruder equipped with a crosshead.

<Intermediate Layer>

In the present invention, an intermediate layer may be formed between the electroconductive support and the surface layer.

(Volume Resistivity of Intermediate Layer)

The volume resistivity of a material forming the intermediate layer according to the present invention is $1\times10^{10}$ Ω·cm or more and $1\times10^{16}$ Ω·cm or less. When the volume resistivity of the material forming the intermediate layer is set to $1\times10^{10}$ Ω·cm or more, a potential difference between the surface of the electroconductive support and the surface of the electroconductive member increases when a voltage is applied to the electroconductive member, and hence discharge from the surface of the electroconductive support to the surface of the electroconductive member becomes strong. Further, when the volume resistivity of the material forming the intermediate layer is set to $1\times10^{16}$ Ω·cm or less, an electric resistance value required for injection charging can be ensured. Note that, a method of measuring the volume resistivity of the intermediate layer is similar to the method of measuring the volume resistivity of the surface layer.

(Porous Body Structure of Intermediate Layer)

The intermediate layer in the present invention is a porous body including a pore that is continuous from an interface between the intermediate layer and the electroconductive support to an interface between the intermediate layer and the surface layer, and an opening of the pore in the intermediate layer communicates to an opening of the pore in the surface layer at the interface between the intermediate layer and the surface layer. That the intermediate layer includes the pore that is continuous from the interface between the intermediate layer and the electroconductive support to the interface between the intermediate layer and the surface layer refers to that the pore is continuous without being disconnected from the interface between the intermediate layer and the electroconductive support to the interface between the intermediate layer and the surface layer when viewed in a three-dimensional image of the intermediate layer obtained with a three-dimensional transmission electron microscope. By forming the intermediate layer as the porous body including the pore that is continuous from the interface between the intermediate layer and the electroconductive support to the interface between the intermediate layer and the surface layer, discharge from the surface of the electroconductive support can reach the foreign matter through the pore without being disconnected. Further, the pore in the intermediate layer is continuous from the interface between the intermediate layer and the electroconductive support to the interface between the intermediate layer and the surface layer, and the opening of the pore in the intermediate layer and the opening of the pore in the surface layer communicate to each other at the interface between the intermediate layer and the surface layer. Therefore, discharge from the surface of the electroconductive support can reach the surface of the surface layer. In order to confirm that the opening of the pore in the intermediate layer and the opening of the pore in the surface layer communicate to each other, a segment including the intermediate layer is cut from the electroconductive member, and a cross section of the segment is processed and observed with an FIB-SEM device.

(Porosity of Intermediate Layer)

The porosity of the intermediate layer according to the present invention is 40% or more and 95% or less. When the porosity is set to 40% or more, discharge from the surface of the electroconductive support can be transmitted in a sufficient amount to the surface of the surface layer through the pore in the intermediate layer. Further, when the porosity of the intermediate layer is set to 95% or less, the pore can be prevented from becoming non-continuous due to the crushing of the intermediate layer caused by the nip with respect to the photosensitive drum, and thus discharge from the surface of the electroconductive support can be transmitted to the surface of the surface layer.

The porosity of the intermediate layer can be measured by cutting a segment including the intermediate layer from the electroconductive member and subjecting the segment to X-ray CT measurement. Note that, the electroconductive member is divided equally into ten regions in a longitudinal direction so that measurement points for the porosity are not biased, and any one point (ten points in total) in each of the ten divided regions is defined as a measurement point.

(Thickness of Intermediate Layer)

The thickness of the intermediate layer in the present invention is 3 μm or more and 100 μm or less. When the thickness of the intermediate layer is set to 3 μm or more, a potential difference between the surface of the electroconductive support and the surface of the electroconductive member can be increased sufficiently for performing discharge. Further, when the thickness of the intermediate layer is set to 100 μm or less, an electric resistance value required as the electroconductive member can be ensured.

The thickness of the intermediate layer can be measured by cutting a segment including the intermediate layer from the electroconductive member and processing and observing a cross section of the segment with an FIB-SEM device. Note that, the electroconductive member is divided equally into ten regions in a longitudinal direction so that measurement points are not biased, and any one point (ten points in total) in each of the ten divided regions is defined as a measurement point.

(Material for Intermediate Layer)

There is no particular limitation on a material forming the porous body of the intermediate layer according to the present invention, and for example, the same material as that for the surface layer may also be used. An organic material such as a resin material, an inorganic material such as silica or titania, or a hybrid material of the organic material and the inorganic material may be used.

(Method of Producing Porous Body of Intermediate Layer)

There is no particular limitation on a method of producing the porous body of the intermediate layer according to the present invention as long as the porous body can be formed as the intermediate layer. For example, there may be given a production method similar to that for the porous body of the surface layer.

(Electroconducting Agent of Intermediate Layer)

An electroconducting agent for adjusting an electric resistance value may be added to the porous body of the intermediate layer according to the present invention as long as the effect of the present invention is not impaired and as long as the intermediate layer can be formed. Examples of the conducting agent include electronic conducting agents, which exhibit electronic conductivity, such as carbon black, graphite, an oxide (e.g. tin oxide), a metal (e.g. copper or silver), and electroconductive particles obtained by covering a particle surface with the oxide or the metal so as to impart electroconductivity to the particle surface; or ionic conducting agents having ion-exchange performance, which exhibit ionic conductivity, such as a quaternary ammonium salt and a sulfonate. In addition, a filler, a softener, a processing aid, a tackifier, an anti-tack agent, and a dispersant, which are generally used as agents to be blended in a resin, may be added as long as the effect of the present invention is not impaired.

<Rigid Structure Configured to Protect Porous Body>

The effect of the present invention is expressed due to the presence of the porous body on the surface of the electroconductive member. When the porous body changes in structure, there is a risk in that discharging characteristics may also change. Thus, particularly in the case where the long-term use is intended, it is preferred that the friction and wearing between the surface of the photosensitive drum and the porous body are reduced so as to suppress a change in structure of the porous body by introducing a rigid structure configured to protect the porous body.

In this case, the rigid structure refers to a structure that is deformed in an amount of 1 μm or less when abutting against the photosensitive drum.

There is no limitation on a method of providing the rigid structure as long as the effect of the present invention is not impaired. For example, there may be given a method involving forming a convex portion on the surface of the electroconductive support and a method involving introducing a spacing member into the electroconductive member.

(Convex Portion on Surface of Electroconductive Support)

As a method of forming a convex portion on the surface of the electroconductive support, there may be given a method involving processing the surface of the electroconductive support so as to form a convex portion. As examples thereof, there may be given sandblasting, laser processing, and polishing. However, the method is not limited to the above-mentioned production methods as long as the convex portion can be formed on the surface of the electroconductive support.

There is also given a method involving processing the surface of the surface layer so as to form a convex portion. As examples thereof, there may be given sandblasting, laser processing, and polishing of the surface layer, or a method involving dispersing a filler such as organic particles or inorganic particles on the surface layer. As a material for forming the organic particle, there are given, for example, nylon, polyethylene, polypropylene, polyester, polystyrene, polyurethane, a styrene-acrylic copolymer, polymethyl methacrylate, an epoxy resin, a phenol resin, a melamine resin, cellulose, polyolefin, and a silicone resin. In addition, as a material for forming the inorganic particle, there are given, for example, silicon oxide such as silica, aluminum oxide, titanium oxide, zinc oxide, calcium carbonate, magnesium carbonate, aluminum silicate, strontium silicate, barium silicate, calcium tungstate, clay mineral, mica, talc, and kaolin.

In addition to the above-mentioned method involving processing the electroconductive support, as a method involving introducing a convex portion independent from the electroconductive support, for example, there may be given a method involving applying fine powder to an outer peripheral surface of the electroconductive support and a method involving winding a thread-shaped member such as a wire around the outer peripheral surface of the electroconductive support.

It is preferred that, in order to obtain the effect of protecting the porous body, the existence density of the convex portion is set such that at least a part of the rigid structure is observed in a square region measuring 1.0 mm per side in a surface of the porous body when observed from a direction facing the porous body.

There is no limitation on the size and thickness of the convex portion as long as the effect of the present invention is not impaired. Specifically, it is preferred that the size and thickness of the convex portion fall within a range in which an image defect is not caused by the presence of the convex portion.

There is no limitation on the height of the convex portion as long as the height of the convex portion is larger than the thickness of the porous body and the effect of the present invention is not impaired. Specifically, it is preferred that the height of the convex portion fall within a range in which the height of the convex portion is larger than at least the thickness of the porous body and a charging defect is not caused by a large discharging gap.

(Spacing Member)

There is no limitation on the spacing member as long as the spacing member can separate the photosensitive drum and the porous body from each other and the effect of the present invention is not impaired. Examples of the spacing member include a ring and a spacer.

As an example of a method of introducing the spacing member, in the case where the electroconductive member has a roller shape, there is given a method involving inserting, onto the mandrel, a ring having an outer diameter larger than that of the electroconductive member and having a hardness capable of holding a void between the photosensitive drum and the electroconductive member. Further, as another example of the method of introducing a spacing member, in the case where the electroconductive member has a blade shape, there is given a method involving introducing a spacer capable of separating the porous body and the photosensitive drum from each other so as to prevent friction and wearing between the porous body and the photosensitive drum.

There is no limitation on a material forming the spacing member as long as the effect of the present invention is not impaired. For example, as the material forming the spacing member, it is sufficient that a known non-electroconductive material be used appropriately in order to prevent electric conduction through the spacing member. Examples of the material for the spacing member include: polymer materials excellent in sliding property such as a polyacetal resin, a high-molecular-weight polyethylene resin, and a nylon resin; and metal oxide materials such as titanium oxide and aluminum oxide.

Figure 3:
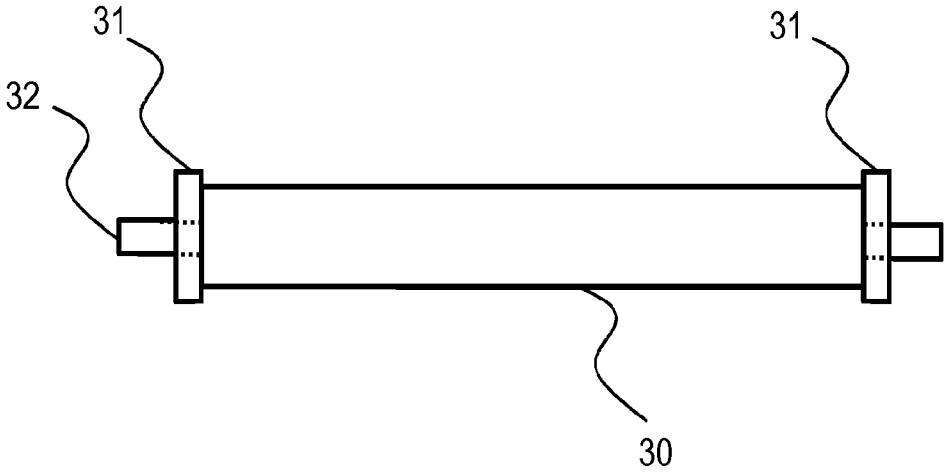
FIG. 3 is a schematic configuration view illustrating an example (roller shape) in the case where the electroconductive member according to the present invention includes a spacing member.

FIG. 3 illustrates an example (roller shape) of the electroconductive member in the case where the spacing member is introduced. In FIG. 3, reference numerals 30, 31, and 32 denote an electroconductive member, a spacing member, and an electroconductive mandrel, respectively.

There is no limitation on a method of introducing the spacing member as long as the effect of the present invention is not impaired, and for example, the spacing member may be set at both ends in a longitudinal direction of the electroconductive support.

<Process Cartridge>

An example of a process cartridge for electrophotography using the electroconductive member according to the present invention as a charging roller is described with reference to FIG. 1. A process cartridge 5 includes a developing device and a charging device integrally and is designed so as to be removably mounted onto the main body of an electrophotographic apparatus. The developing device includes at least a developing roller 7 and a developing container 10 integrally, and as needed, may include a toner supply roller 11, a toner 8, a developing blade 12, and a stirring blade 9. The charging device includes at least a photosensitive drum 6, the cleaning blade 22, and a charging roller 13 integrally, and may include a waste toner container 23. The charging roller 13, the developing roller 7, the toner supply roller 11, and the developing blade 12 are each configured to be supplied with a voltage.

<Electrophotographic Apparatus>

Next, an example of an electrophotographic apparatus using the electroconductive member of the present invention as a charging roller is descried with reference to FIG. 1.

The electrophotographic apparatus illustrated in FIG. 1 includes one each of electrophotographic process cartridges 5 for respectively forming a yellow image, a cyan image, a magenta image, and a black image in a tandem system.

The developing device includes the photosensitive drum 6 and the developing container 10 accommodating the developing roller 7 and the toner 8, which is set so as to face the photosensitive drum 6. The developing device further includes the toner supply roller 11 configured to supply the toner to the developing roller and to scrape off the toner 8 that remains on the developing roller 7 without being used for development, and the developing blade 12 configured to regulate the amount of the toner 8 carried on the developing roller 7 and to triboelectrically charge the developing roller 7.

The charging roller 13 is held in abutment against the photosensitive drum 6 with a predetermined pressure force so as to follow the rotation of the photosensitive drum 6. When a DC voltage is applied from a power source to the charging roller, the photosensitive drum 6 is uniformly charged to a predetermined polarity and potential. When a surface of the photosensitive drum 6 is irradiated with a beam 14 serving as image information, an electrostatic latent image is formed on the surface. Then, the toner 8 applied onto the developing roller 7 is supplied from the developing roller 7 onto the electrostatic latent image so that a toner image is formed on the surface of the photosensitive drum 6.

An intermediate transfer belt 15 is tensioned between a drive roller 16 and a tension roller 17, and a primary transfer roller 18 is arranged at a position facing the photosensitive drum on an inner side of a transfer conveyance belt. The toner image on the photosensitive drum 6 is transferred onto the intermediate transfer belt 15 by the primary transfer roller 18. Toner images of the respective colors are successively superimposed on each other so as to form a color image on the intermediate transfer belt.

A transfer material 19 is fed into the apparatus by a sheet feed roller and conveyed to between the intermediate transfer belt 15 and a secondary transfer roller 20. A voltage is applied from a secondary transfer bias power source to the secondary transfer roller 20 so that the color image on the intermediate transfer belt 15 is transferred onto the transfer material 19.

The transfer material having the toner image transferred thereon is fed to a fixing device 21 so that the toner image is fixed onto the transfer material, and thus image formation is completed. On the other hand, the photosensitive drum that has finished transferring the toner image further rotates so that the surface of the photosensitive drum 6 is cleaned with the cleaning blade 22.

The electroconductive member of the present invention can also be used as a charging roller adopting an AC charging method in which a voltage including a DC voltage and an AC voltage superimposed on each other is applied to the charging roller, as well as the charging roller adopting a DC charging method in which only a DC voltage is applied to the charging roller. Further, besides the above-mentioned electrophotographic apparatus, the electroconductive member of the present invention can also be used in an electrophotographic apparatus which does not include a transfer conveyance belt and in which the photosensitive drum and the transfer roller are held in direct contact with each other.

EXAMPLES

Now, the present invention is further specifically described by way of Examples. The present invention is not limited to Examples described below. Note that, in Examples, an x-axis direction, a y-axis direction, and a z-axis direction respectively refer to the following directions.

The x-axis direction refers to a longitudinal direction of a roller.

The y-axis direction refers to a tangential direction in a transverse cross section (that is, a circular cross section) of the roller orthogonal to an x-axis.

The z-axis direction refers to a diameter direction in the transverse cross section of the roller orthogonal to the x-axis.

[Production of Electroconductive Roller A]

Materials shown in Table 1 below were mixed with a 6-liter pressure kneader (trade name: "TD6-15MDX", manufactured by Toshin Co., Ltd.) at a filling rate of 70 volume % and a blade rotation speed of 35 rpm ($min^{-1}$) for 16 minutes. Thus, an unvulcanized rubber composition A was obtained.

TABLE 1

| Material | Parts by mass |
|---|---|
| NBR (Trade name: Nipol DN219, manufactured by Zeon Corporation) | 100 |
| Carbon black (Trade name: #7360SB, manufactured by Tokai Carbon Co., Ltd.) | 48 |
| Calcium carbonate (Trade name: Nanox #30, manufactured by Maruo Calcium Co., Ltd.) | 20 |
| Zinc oxide (Trade name: ZINC OXIDE TYPE II, manufactured by Seido Chemical Industry Co., Ltd.) | 5 |
| Zinc stearate | 1 |

Next, 1.2 parts by mass of sulfur and 4.5 parts by mass of tetrabenzyl thiuram disulfide (trade name: "Perkacit TBzTD", manufactured by Flexsys K.K.) were added to 174 parts by mass of the unvulcanized rubber composition A. Then, the mixture was bilaterally cut a total of twenty times with open rolls each having a roll diameter of 12 inches at a front roll rotation speed of 8 rpm, a back roll rotation speed of 10 rpm, and a roll interval of 2 mm. After that, the resultant was subjected to tight milling ten times at a roll interval of 0.5 mm. Thus, a kneaded product A for an electroconductive layer was obtained.

Next, a columnar mandrel made of steel (having a diameter of 6 mm, a length of 252 mm, and a nickel-plated surface) was prepared. A thermosetting adhesive (trade name: "Metaloc U-20", manufactured by TOYOKAGAKU KENKYUSHO CO., LTD.) was applied to a region having a width in an axial direction of the mandrel of 231 mm. The thermosetting adhesive was heated at 80° C. for 30 minutes, and thereafter further heated at 120° C. for 1 hour.

The kneaded product A and the mandrel having the adhesive layer formed thereon were extruded together, with an extruder equipped with a crosshead, and the kneaded product A was formed into a roller shape having an outer diameter of from 8.75 to 8.90 mm so as to cover the mandrel. Thus, an unvulcanized rubber roller A was obtained. The extruder equipped with a crosshead had a cylinder diameter of 70 mm, an L/D of 20, a head temperature of 90° C., a cylinder temperature of 90° C., and a screw temperature of 90° C.

Then, the kneaded product A in the unvulcanized rubber roller A was vulcanized with a continuous heating furnace having two zones set to different temperatures. Specifically, the unvulcanized rubber roller A was caused to pass through the first zone set to a temperature of 80° C. within 30 minutes, and then passed through the second zone set to a temperature of 160° C. also within 30 minutes. Thus, a vulcanized rubber roller A including a vulcanized electroconductive layer was obtained.

Next, both ends of the electroconductive layer in the vulcanized rubber roller A were cut so that the length in an axial direction of the electroconductive layer was set to 232 mm. Then, a surface of the electroconductive layer was polished with a rotary grindstone so as to obtain an electroconductive roller A including a crown-shaped electroconductive layer having a diameter at each end of 8.26 mm and a diameter at a central portion of 8.50 mm in the axial direction.

[Production of Electroconductive Roller B]

Materials shown in Table 2 below were mixed with a pressure kneader adjusted to a temperature of 100° C. for 10 minutes. Thus, an unvulcanized rubber composition B was obtained.

TABLE 2

| Material | Parts by mass |
|---|---|
| Epichlorohydrin rubber (Epichlorohydrin:ethylene oxide:allyl glycidyl ether = 40 mol %:56 mol %:4 mol %) | 100 |
| Carbon black (Trade name: Seast SO, manufactured by Tokai Carbon Co., Ltd.) | 8 |
| Calcium carbonate (Trade name: Silver W, manufactured by Maruo Calcium Co., Ltd.) | 35 |
| Zinc oxide (Trade name: ZINC OXIDE TYPE II, manufactured by Seido Chemical Industry Co., Ltd.) | 5 |
| Zinc stearate | 2 |
| Tetrabutylammonium perchlorate | 5 |
| Adipic acid ester (Trade name: Polycizer W305ELS, Dainippon Ink & Chemicals, Inc.) | 10 |

Next, 0.5 part by mass of sulfur and 2 parts by mass of dipentamethylene thiuram tetrasulfide (trade name: "Nocceler TRA", manufactured by OUCHI SHINKO CHEMICAL INDUSTRIAL CO., LTD.) were added to 165 parts by mass of the unvulcanized rubber composition B. Then, the mixture was bilaterally cut a total of twenty times with open rolls each having a roll diameter of 12 inches at a front roll rotation speed of 8 rpm, a back roll rotation speed of 10 rpm, and a roll interval of 2 mm. After that, the resultant was subjected to tight milling ten times at a roll interval of 0.5 mm. Thus, a kneaded product B for an electroconductive layer was obtained.

Next, a columnar mandrel made of steel (having a diameter of 6 mm, a length of 252 mm, and a nickel-plated surface) was prepared. A thermosetting adhesive (trade name: "Metaloc U-20", manufactured by TOYOKAGAKU KENKYUSHO CO., LTD.) was applied to a region having a width in an axial direction of the mandrel of 231 mm. The thermosetting adhesive was heated at 80° C. for 30 minutes, and thereafter further heated at 120° C. for 1 hour.

The kneaded product B and the mandrel having the adhesive layer formed thereon were extruded together, with an extruder equipped with a crosshead, and the kneaded product B was formed into a roller shape having an outer diameter of from 8.75 to 8.90 mm so as to cover the mandrel. Thus, an unvulcanized rubber roller B was obtained. The extruder equipped with a crosshead had a cylinder diameter of 70 mm, an L/D of 20, a head temperature of 70° C., a cylinder temperature of 70° C., and a screw temperature of 70° C.

Then, the kneaded product B in the unvulcanized rubber roller B was vulcanized at a temperature of 160° C. for 30 minutes so as to obtain a vulcanized rubber roller B having an electroconductive layer.

Next, both ends of the electroconductive layer in the vulcanized rubber roller B were cut so that the length in an axial direction of the electroconductive layer was set to 232 mm. Then, a surface of the electroconductive layer was polished with a rotary grindstone so as to obtain an electroconductive roller B including a crown-shaped electroconductive layer having a diameter at each end of 8.26 mm and a diameter at a central portion of 8.50 mm in the axial direction.

Example 1

Preparation of Intermediate Layer Coating Solution A 60 g of PMMA (weight-average molecular weight: 350,000), 60 ml of distilled water, and 240 ml of ethanol were added to an eggplant flask (0.20 g/ml of PMMA with respect to the solvent). The mixture was refluxed by heating while stirring so that PMMA was dissolved. Thus, an intermediate layer coating solution A was prepared.

[Production of Intermediate Layer]

The intermediate layer coating solution A was applied to the electroconductive roller B by dip coating. The intermediate layer coating solution A applied to the electroconductive roller B was dried for 1 hour with a hot-air circulating drier set to 30° C. so as to obtain the electroconductive roller B having an intermediate layer on a surface of the electroconductive layer.

[Measurement of Volume Resistivity of Material Forming Intermediate Layer]

The volume resistivity of a material (skeleton) forming an intermediate layer was measured in a contact mode through use of a scanning probe microscope (SPM) (trade name: "Q-Scope 250", manufactured by Quesant Instrument Corporation). The skeleton forming the intermediate layer was collected from the electroconductive support with tweezers, and the collected sample was placed on a metal plate made of stainless steel. Then, a portion that is held in direct contact with the metal plate was selected, and a cantilever of the SPM was brought into contact with the portion. A voltage of 50 V was applied to the cantilever and a current value was measured. Then, by using the thickness of the sample where the cantilever was contacted, and the contact area of the cantilever with the sample obtained from the surface shape observed with the SPM, the current value was converted into a volume resistivity.

In the above-mentioned measurement, the electroconductive member was divided equally into ten regions in a longitudinal direction, and the intermediate layer was collected for measurement from a total of ten points, each being optionally selected from the respective regions, with tweezers, and an average value of the ten measured values was defined as the volume resistivity of the skeleton forming the intermediate layer.

[Thickness Measurement of Intermediate Layer]

A blade of a cutter was brought into contact with the electroconductive roller having the intermediate layer so that a segment having a length of 250 μm each in an x-axis direction and a y-axis direction was obtained. A cross section of the segment thus obtained was processed with an acceleration voltage of 30 kV and then photographed with an acceleration voltage of 1.0 kV in a direction perpendicular to the cross section, through use of an FIB-SEM device (trade name: "Helios 600", manufactured by FEI Company). The thickness of the intermediate layer was measured from the photographed image. This measurement was performed at any one point (ten points in total) in each of ten regions obtained by equally dividing the electroconductive member into ten regions in a longitudinal direction, and an average of the thicknesses at the ten points was defined as the thickness of the intermediate layer.

[Porosity Measurement of Intermediate Layer]

A blade of a cutter was brought into contact with the electroconductive roller having the intermediate layer so that a segment having a length of 250 μm each in an x-axis direction and a y-axis direction was obtained. Then, the segment was subjected to three-dimensional reconstruction with an X-ray CT inspection device (trade name: "TOHKEN-SkyScan 2011" (radiation source: TX-300), manufactured by Mars Tohken X-ray Inspection Co., Ltd.). Two-dimensional slice images (parallel to an xy-plane) were cut from the three-dimensional image thus obtained at an interval of 1 μm with respect to a z-axis, and the slice images were binarized so that a skeleton and a pore were identified. In each of the binarized slice images, a ratio Rp (%) of the pore was determined. This measurement was performed at any one point (ten points in total) in each of ten regions obtained by equally dividing the electroconductive member into ten regions in a longitudinal direction, and an average of the ratios at the ten points was defined as the porosity of the intermediate layer.

[Preparation of Surface Layer Coating Solution]

3 g of PMMA (weight-average molecular weight: 350,000), 1.5 g of carbon black (trade name: "SBX55", manufactured by Asahi Carbon Co., Ltd.) (55 parts by mass with respect to PMMA), 60 ml of distilled water, and 240 ml of ethanol were added to an eggplant flask (0.01 g/ml of PMMA with respect to the solvent). The mixture was refluxed by heating while stirring so that PMMA was dissolved. Thus, a surface layer coating solution was prepared.

[Production of Surface Layer]

The surface layer coating solution was applied to the electroconductive roller B having the intermediate layer on the surface by dip coating. The surface layer coating solution applied to the electroconductive roller B was dried for 1 hour with a hot-air circulating drier set to 30° C. so as to obtain an electroconductive member having a surface layer of a porous body on a surface.

[Confirmation of Co-Continuous Structure of Surface Layer]

A blade of a cutter was brought into contact with the electroconductive member so that a segment having a length of 250 μm each in an x-axis direction and in a y-axis direction was obtained. Then, the segment was subjected to three-dimensional reconstruction with an X-ray CT inspection device (trade name: "TOHKEN-SkyScan 2011" (radiation source: TX-300), manufactured by Mars Tohken X-ray Inspection Co., Ltd.). Two-dimensional slice images (parallel to an xy-plane) were cut from the three-dimensional image thus obtained at an interval of 1 μm with respect to a z-axis, and the slice images were binarized so that a skeleton portion and a pore portion were identified. The slice images were checked successively with respect to the z-axis, and thus it was confirmed that the skeleton portion and the pore portion were three-dimensionally continuous.

[Shape Measurement of Opening of Pore of Surface Layer]

The shape of the opening of the pore of the surface layer was measured as follows. First, a segment having a length of 5 mm each in an x-axis direction and in a y-axis direction was cut from the surface layer with a blade of a cutter, and platinum was vapor-deposited on the entire segment. Then, a surface of the surface layer was observed at a magnification of 2,000 times with a scanning electron microscope (trade name: "S-4800", manufactured by Hitachi High-Technologies Corporation) so as to obtain a surface observation image.

The surface observation image was made into a gray scale and binarized with image processing software (trade name: "Imageproplus", manufactured by Nippon Roper K.K.). A perimeter L and an area S of the opening of each pore in the binarized image were determined and a circularity K was calculated by $L^2/4\pi S$.

Similarly, the electroconductive member was divided equally into ten regions in a longitudinal direction. A surface observation image of the surface layer was obtained from any one point (ten points in total) in each of the regions so that a circularity was determined. An arithmetic average of the circularity K of the opening of the pore was calculated from the circularities at the ten points thus obtained.

[Volume Resistivity Measurement of Material Forming Surface Layer]

The volume resistivity of the material forming the surface layer was measured by the same method as in the volume resistivity measurement of the material forming the intermediate layer, except for using, as a sample, a skeleton forming the surface layer of the electroconductive member collected from the electroconductive member with tweezers.

[Thickness Measurement of Surface Layer]

The thickness of the surface layer was measured by the same method as in the thickness measurement of the intermediate layer, except for using, as a sample, a segment including the surface layer of the electroconductive member cut from the electroconductive member.

[Observation of Pore of Intermediate Layer]

A blade of a cutter was brought into contact with the electroconductive member so that a segment having a length of 250 μm each in an x-axis direction and in a y-axis direction was obtained. Then, the segment was subjected to three-dimensional reconstruction with an X-ray CT inspection device (trade name: "TOHKEN-SkyScan 2011" (radiation source: TX-300), manufactured by Mars Tohken X-ray Inspection Co., Ltd.). Two-dimensional slice images (parallel to an xy-plane) were cut from the three-dimensional image thus obtained at an interval of 1 μm with respect to a z-axis, and the slice images were binarized so that a skeleton portion and a pore portion were identified. The slice images were checked successively with respect to the z-axis, and thus it was confirmed that the pore was continuous from the interface between the electroconductive layer and the intermediate layer to the interface between the surface layer and the intermediate layer.

A blade of a cutter was brought into contact with the electroconductive member so that a segment having a length of 250 μm each in an x-axis direction and a y-axis direction was obtained. A cross section of the segment thus obtained was processed with an acceleration voltage of 30 kV and then photographed with an acceleration voltage of 1.0 kV in a direction perpendicular to the cross section, through use of an FIB-SEM device (trade name: "Helios 600", manufactured by FEI Company). It was confirmed from the photographed image that the opening of the pore in the intermediate layer and the opening of the pore in the surface layer communicated to each other. This confirmation was performed at any one point (ten points in total) in each of ten regions obtained by equally dividing the electroconductive member into ten regions in a longitudinal direction.

[Evaluation of Density Unevenness]

The density unevenness caused by foreign matter adhering to the electroconductive member was evaluated. A color laser printer (trade name: "Color LaserJet Enterprise CP 4525dn", manufactured by Hewlett-Packard Development Company, L.P.) and an electrophotographic process cartridge of magenta therefor were prepared. A charging roller was removed from the electrophotographic process cartridge, and the produced electroconductive member was incorporated instead into the electrophotographic process cartridge as a charging roller. Further, in order to accelerate the adhesion of the foreign matter, a cleaning blade was removed from the electrophotographic process cartridge. The color laser printer and the electrophotographic process cartridge were left to stand at a temperature of 23° C. and a humidity of 50% RH for 24 hours and then evaluated for durability in this environment. Specifically, an E-letter image having a printing rate of 1% was output onto 15,000 sheets continuously, and finally a half-tone image was output. The half-tone image was observed visually, and a streak-like image or a spot-like image occurring due to the adhesion of the foreign matter was evaluated as density unevenness. The density unevenness was evaluated as follows.

A: No streak-like image or spot-like image is observed.

B: A streak-like image or a spot-like image can be confirmed in a region having a width of 2 cm.

C: A streak-like image or a spot-like image can be confirmed in a region having a width of 5 cm.

D: A streak-like image or a spot-like image can be confirmed in an entire surface.

[Shaving Evaluation of Surface Layer]

In order to evaluate the durability of the surface layer, an E-letter image having a printing rate of 1% was output onto 15,000 sheets continuously. Then, a surface of the surface layer was observed at a magnification of 500 times with an optical microscope (trade name: "VHX-900", manufactured by Keyence Corporation). The shaving was evaluated as follows.

A: No shaving is observed.

B: Shaving is observed in less than 5% of a surface area.

C: Shaving is observed in 5% or more of a surface area.

[Adhesion Amount of Foreign Matter]

The adhesion amount of the foreign matter adhering to the surface of the surface layer was evaluated based on a tape colored density. The charging roller evaluated for durability in the foregoing was prepared, and the foreign matter adhering to the surface of the surface layer was scraped off with a tape (trade name: "Scotch Mending Tape", manufactured by Sumitomo 3M Limited) in an entire region of the charging roller in a longitudinal direction. Then, the tape was attached to white paper (trade name: "Business 4200", manufactured by XEROX Corporation), and the reflection density was measured with a reflection densitometer (trade name: "X-Rite 504", manufactured by X-Rite Inc.). The tape was divided equally into 10 regions in a longitudinal direction so as to obtain measurement points, and the reflection density of a central portion in each of the regions was measured. Further, only a tape attached to white paper as a blank was defined as a reference, and a total of differences in reflection density from the reference at ten measurement points was defined as the adhesion amount of the foreign matter. As the total of the differences in reflection density from the reference is smaller, the adhesion amount of the foreign matter is smaller.

Tables 9 and 10 show the evaluation results of Examples and Comparative Examples below collectively.

Examples 2 to 17

Each electroconductive member was produced in the same way as in Example 1 and evaluated, except for changing the kind of the electroconductive roller, the number of parts of the materials for and the heating temperature of the intermediate layer coating solution, and the materials for and the heating temperature of the surface layer coating solution as shown in Table 3 below. Note that, in Examples 8 to 17, electroconductive rollers not having the intermediate layer were used, and hence a symbol "–" was described in the column of the intermediate layer of Examples 8 to 17 in Table 3.

TABLE 3

| | | Intermediate layer | | | | Surface layer | | | |
|---|---|---|---|---|---|---|---|---|---|
| | Electro-conductive roller | CB (Parts by mass) | PMMA (Molecular weight) | PMMA (g/ml) | Heating temperature (° C.) | CB (Parts by mass) | PMMA (Molecular weight) | PMMA (g/ml) | Heating temperature (° C.) |
| Example 1 | B | 0 | 350,000 | 0.2 | 30 | 55 | 350,000 | 0.01 | 30 |
| Example 2 | B | 0 | 350,000 | 0.2 | 30 | 45 | 350,000 | 0.01 | 30 |
| Example 3 | B | 25 | 350,000 | 0.2 | 30 | 55 | 15,000 | 0.01 | 30 |
| Example 4 | B | 0 | 15,000 | 0.01 | 40 | 55 | 350,000 | 0.01 | 40 |
| Example 5 | B | 25 | 15,000 | 0.01 | 40 | 55 | 15,000 | 0.01 | 40 |
| Example 6 | B | 0 | 350,000 | 0.2 | 60 | 55 | 15,000 | 0.09 | 60 |
| Example 7 | B | 0 | 350,000 | 0.2 | 60 | 45 | 15,000 | 0.09 | 60 |
| Example 8 | B | — | — | — | — | 55 | 350,000 | 0.09 | 40 |
| Example 9 | B | — | — | — | — | 45 | 350,000 | 0.09 | 40 |
| Example 10 | B | — | — | — | — | 55 | 350,000 | 0.09 | 40 |
| Example 11 | B | — | — | — | — | 45 | 15,000 | 0.09 | 40 |
| Example 12 | B | — | — | — | — | 55 | 15,000 | 0.09 | 40 |
| Example 13 | B | — | — | — | — | 45 | 15,000 | 0.09 | 60 |

TABLE 3-continued

| | Electro-conductive roller | Intermediate layer CB (Parts by mass) | PMMA (Molecular weight) | PMMA (g/ml) | Heating temperature (° C.) | Surface layer CB (Parts by mass) | PMMA (Molecular weight) | PMMA (g/ml) | Heating temperature (° C.) |
|---|---|---|---|---|---|---|---|---|---|
| Example 14 | B | — | — | — | — | 55 | 350,000 | 0.2 | 30 |
| Example 15 | B | — | — | — | — | 45 | 350,000 | 0.2 | 30 |
| Example 16 | B | — | — | — | — | 55 | 15,000 | 0.2 | 30 |
| Example 17 | B | — | — | — | — | 45 | 15,000 | 0.2 | 30 |

Example 18

The same process as that of Example 1 was performed up to the production of the intermediate layer.

[Preparation of Surface Layer Coating Solution]

19.3 g of styrene, 3.3 g of divinylbenzene, 11.3 g of carbon black (trade name: "SBX55", manufactured by Asahi Carbon Co., Ltd.) (50 parts by mass of carbon black with respect to the total amount of styrene and divinylbenzene), 1.1 g of sorbitan monooleate, and 0.14 g of 2,2'-azodiisobutyronitrile were mixed so as to obtain a uniform solution. The solution and 180 g of water were stirred with a planetary mixer so as to prepare a W/O emulsion solution.

[Production of Surface Layer]

The emulsion solution was poured into a mold, in which the electroconductive roller B having the intermediate layer on the surface was set, and nitrogen replacement was performed. Then, the solution was polymerized in the sealed mold at 70° C. for 24 hours. The resultant was removed from the mold and washed with 2-propanol. The resultant was dried for 1 hour with a hot-air circulating drier at 85° C. so as to produce an electroconductive member and the electroconductive member was evaluated.

Examples 19 to 25

Each electroconductive member was produced and evaluated in the same way as in Example 18, except for changing the kind of the electroconductive roller, the number of parts of the materials for and the heating temperature of the intermediate layer coating solution, and the number of parts and the heating temperature during polymerization of carbon black (CB) used for the surface layer coating solution as shown in Table 4 below. Note that, in Examples 22 to 25, electroconductive rollers not having the intermediate layer were used, and hence a symbol "–" was described in the column of the intermediate layer of Examples 22 to 25 in Table 4.

TABLE 4

| | Electro-conductive roller | Intermediate layer CB (Parts by mass) | PMMA (Molecular weight) | PM MA (g/ml) | Heating Tempera-ture (° C.) | Surface layer CB (Parts by mass) | Heating Tempera-ture (° C.) |
|---|---|---|---|---|---|---|---|
| Example 18 | B | 0 | 350,000 | 0.2 | 30 | 50 | 70 |
| Example 19 | B | 0 | 350,000 | 0.2 | 30 | 40 | 70 |
| Example 20 | B | 0 | 350,000 | 0.2 | 30 | 50 | 50 |
| Example 21 | B | 0 | 350,000 | 0.2 | 30 | 40 | 50 |
| Example 22 | B | — | — | — | — | 50 | 70 |
| Example 23 | B | — | — | — | — | 40 | 70 |
| Example 24 | B | — | — | — | — | 50 | 50 |
| Example 25 | B | — | — | — | — | 40 | 50 |

Example 26

The electroconductive roller A having the intermediate layer on the surface of the electroconductive layer was produced in the same way as in Example 1 up to the production of the intermediate layer, except for using the electroconductive roller A instead of the electroconductive roller B.

[Preparation of Surface Layer Coating Solution B]

A surface layer coating solution B was prepared by mixing and stirring materials shown in Table 5 below.

TABLE 5

| Material | Blending amount |
|---|---|
| JEFFAMINE ED-900 (manufactured by Huntsman Japan K.K.) | 2.47 g |
| Polypropylene glycol diglycidyl ether (Trade name: EX-931, manufactured by Nagase ChemteX Corporation) | 3.53 g |
| Glycidyltrimethylammonium bis(trifluoromethanesulfonyl)imide | 0.12 g |
| Water | 1.80 g |
| Polyethylene glycol (Weight-average molecular weight: 200) | 16.2 g |

[Production of Surface Layer]

The surface layer coating solution B was poured into a mold, in which the electroconductive roller A having the intermediate layer on the surface was set, and nitrogen replacement was performed. Then, the solution was left to stand still in the sealed mold at 80° C. for 24 hours. The solution was heated at 120° C. for 1 hour, and thereafter was removed from the mold. The resultant was immersed in a 50% ethanol aqueous solution for 1 day. Further, the resultant was dried for 1 hour with a hot-air circulating drier at 100° C. so that an electroconductive member was produced and evaluated.

Examples 27 to 35

Surface layer coating solutions A and C to E were prepared as follows.

[Preparation of Surface Layer Coating Solution A]

The surface layer coating solution A was prepared in the same way as in the surface layer coating solution B, except for adding 3.00 g of carbon black (trade name: "SBX55", manufactured by Asahi Carbon Co., Ltd.).

[Preparation of Surface Layer Coating Solution C]

The surface layer coating solution C was prepared by mixing and stirring materials shown in Table 6 below.

TABLE 6

| Material | Blending amount |
|---|---|
| JEFFAMINE D-400 (manufactured by Huntsman Japan K.K.) | 1.43 g |
| Polypropylene glycol diglycidyl ether (Trade name: EX-931, manufactured by Nagase ChemteX Corporation) | 4.57 g |

TABLE 6-continued

| Material | Blending amount |
|---|---|
| Glycidyltrimethylammonium bis(trifluoromethanesulfonyl)imide | 0.12 g |
| Water | 1.80 g |
| Polyethylene glycol (Weight-average molecular weight: 200) | 16.2 g |

[Preparation of Surface Layer Coating Solution D]

The surface layer coating solution D was prepared in the same way as in the surface layer coating solution B, except for changing the addition amount of glycidyltrimethylammonium bis(trifluoromethanesulfonyl)imide to 0.08 g.

[Preparation of Surface Layer Coating Solution E]

The surface layer coating solution E was prepared by mixing and stirring materials shown in Table 7 below.

TABLE 7

| Material | Blending amount |
|---|---|
| JEFFAMINE D-400 (manufactured by Huntsman Japan K.K.) | 4.10 g |
| 1,3-Bis(N,N'-diglycidylaminomethyl cyclohexane) (Trade name: TETRAD-C, manufactured by MITSUBISHI GAS CHEMICAL COMPANY, INC.) | 1.9 g |
| Glycidyltrimethylammonium bis(trifluoromethanesulfonyl)imide | 0.12 g |
| Polyethylene glycol (Weight-average molecular weight: 200) | 18.0 g |

Each electroconductive member was produced and evaluated in the same way as in Example 26, except for changing the kind of the electroconductive roller, the number of parts of the materials for and the heating temperature of the intermediate layer coating solution, and the kind, the molecular weight of ethylene glycol, and the heating temperature of the surface layer coating solution as shown in Table 8 below. Note that, in Example 30, the surface layer coating solution B in which polyethylene glycol (weight-average molecular weight: 400) was used instead of polyethylene glycol (weight-average molecular weight: 200) was used. Further, in Example 34, the surface layer coating solution D in which polyethylene glycol (weight-average molecular weight: 300) was used instead of polyethylene glycol (weight-average molecular weight: 200) was used. Note that, in Table 8, PEG means polyethylene glycol.

TABLE 8

| | | Intermediate layer | | | | Surface layer | | |
|---|---|---|---|---|---|---|---|---|
| | Electroconductive roller | CB (Parts by mass) | PMMA (Molecular weight) | PMMA (g/ml) | Heating temperature (° C.) | Coating solution | PEG (Molecular weight) | Heating temperature (° C.) |
| Example 26 | A | 0 | 350,000 | 0.2 | 30 | B | 200 | 140 |
| Example 27 | A | 0 | 350,000 | 0.2 | 30 | D | 200 | 140 |
| Example 28 | A | — | — | — | — | B | 200 | 140 |
| Example 29 | A | — | — | — | — | D | 200 | 140 |
| Example 30 | A | — | — | — | — | B | 400 | 140 |
| Example 31 | A | — | — | — | — | B | 200 | 120 |
| Example 32 | A | — | — | — | — | E | 200 | 120 |
| Example 33 | A | — | — | — | — | C | 200 | 120 |
| Example 34 | A | — | — | — | — | D | 300 | 120 |
| Example 35 | A | — | — | — | — | A | 200 | 120 |

Example 36

A blade-shaped electroconductive member having a surface layer formed thereon was produced in the same way as in Example 28, except for applying the surface layer coating solution (surface layer coating solution B) of Example 28 onto an aluminum sheet having a thickness of 200 μm by dip coating.

The charging roller was removed from the color laser printer used for evaluating the density unevenness in Example 1 and remodeled so that a charging blade was mounted. Then, the blade-shaped electroconductive member was mounted onto the color laser printer as a charging blade. In this case, the blade-shaped electroconductive member was arranged so as to abut against the photosensitive drum in a forward direction with respect to the rotation direction of the photosensitive drum. Note that, the angle of the blade-shaped electroconductive member at the abutment point between the blade-shaped electroconductive member and the photosensitive drum was set to 20° from the viewpoint of chargeability, and further the abutment pressure of the blade-shaped electroconductive member with respect to the photosensitive drum was set to g/cm (linear pressure). Then, the blade-shaped electroconductive member was evaluated.

Example 37

An electroconductive member was produced and evaluated in the same way as in Example 28, except for applying the surface layer coating solution B of Example 28 directly onto a surface of a mandrel by dip coating.

Example 38

An electroconductive member was produced and evaluated in the same way as in Example 1, except for adding 0.36 g (10 parts by mass with respect to PMMA) of urethane particles (trade name: "Art Pearl C-800T", manufactured by Negami Chemical Industrial Co., Ltd.) having an average particle diameter of 8 μm to the surface layer coating solution.

Example 39

An electroconductive member was produced and evaluated in the same way as in Example 1, except for forming a convex portion having a height of 10 μm by polishing a surface of the electroconductive layer with a rotary grindstone.

Example 40

An electroconductive member was produced and evaluated in the same way as in Example 1, except for inserting rings each formed of a high-molecular-weight polyethylene resin and each having an inner diameter of 6.05 mm, an outer diameter of 8.55 mm, and a thickness of 1.5 mm, serving as spacing members, at both ends of a mandrel.

Comparative Example 1

Preparation of Surface Layer Coating Solution

Methyl isobutyl ketone was added to an ϵ-caprolactone modified acrylic polyol solution (trade name: "Placcel DC2016", manufactured by Daicel Chemical Industries, Ltd.) so that the solution was diluted to adjust the solid content to 19 mass %. Then, 45 parts by mass of carbon black (trade name: "MA100", manufactured by Mitsubishi Chemical Corporation) and 0.08 part by mass of modified dimethyl silicone oil (trade name: "SH28PA", manufactured by Dow Corning Toray Co., Ltd.) were added to 526.3 parts by mass of the diluted solution (100 parts by mass of the acrylic polyol solid content). Further, 80.14 parts by mass of a mixture (7:3) of respective butanoneoxime blocked derivatives of hexamethylene diisocyanate (trade name: "Duranate TPA-B80E", manufactured by Asahi Chemical Industry Co., Ltd.) and isophorone diisocyanate (trade name: "Vestanat B1370", manufactured by Degussa-Huels Ltd.) were added so as to prepare a mixed solution.

200 g of the mixed solution were placed in a glass bottle having a capacity of 450 mL together with 200 g of glass beads having an average particle diameter of 0.8 mm serving as a dispersion medium, and dispersed for 100 hours with a paint shaker disperser. Further, 14 parts by mass of thermally expandable microcapsules (trade name: "MFL-81GCA", manufactured by Matsumoto Yushi-Seiyaku Co., Ltd.) were added to the resultant and dispersed therein for 10 minutes. Then, the glass beads were removed to obtain a surface layer coating solution.

[Production of Surface Layer]

The surface layer coating solution was applied to the electroconductive roller A by dip coating. The surface layer coating solution applied to the electroconductive roller A was heated with a hot-air circulating drier at 80° C. for 1 hour and further at 160° C. for 1 hour. Thus, an electroconductive member having a surface layer of a porous body on the surface was produced and evaluated.

Comparative Example 2

An electroconductive member was produced and evaluated in the same way as in Example 29, except for setting the molecular weight of polyethylene glycol to 1,000. That is, in Comparative Example 2, the surface layer coating solution D, in which polyethylene glycol (weight-average molecular weight: 1,000) was used instead of polyethylene glycol (weight-average molecular weight: 200), was used.

TABLE 9

| | Intermediate layer | | | | Surface layer | | | | | |
|---|---|---|---|---|---|---|---|---|---|---|
| | State of pore | Volume resistivity (Ω · cm) | Porosity (%) | Thickness (μm) | State of pore | Volume resistivity (Ω · cm) | Average diameter of maximum inscribed circle of opening of pore (μm) | Thickness (μm) | Arithmetic average of circularity K | Production method |
| Example 1 | Continuous and communicating | 1.0E+16 | 95 | 100 | Co-continuous | 1.0E+04 | 3 | 3 | 4.0 | Phase separation |
| Example 2 | Continuous and communicating | 1.0E+16 | 95 | 100 | Co-continuous | 1.0E+07 | 3 | 3 | 4.0 | Phase separation |
| Example 3 | Continuous and communicating | 1.0E+10 | 95 | 100 | Co-continuous | 1.0E+04 | 8 | 3 | 4.0 | Phase separation |
| Example 4 | Continuous and communicating | 1.0E+16 | 40 | 3 | Co-continuous | 1.0E+04 | 3 | 3 | 2.0 | Phase separation |
| Example 5 | Continuous and communicating | 1.0E+10 | 40 | 3 | Co-continuous | 1.0E+04 | 8 | 3 | 2.0 | Phase separation |
| Example 6 | Continuous and communicating | 1.0E+16 | 95 | 100 | Co-continuous | 1.0E+04 | 8 | 10 | 1.6 | Phase separation |
| Example 7 | Continuous and communicating | 1.0E+16 | 95 | 100 | Co-continuous | 1.0E+07 | 8 | 10 | 1.6 | Phase separation |
| Example 8 | — | — | — | — | Co-continuous | 1.0E+04 | 3 | 100 | 4.0 | Phase separation |
| Example 9 | — | — | — | — | Co-continuous | 1.0E+07 | 3 | 100 | 4.0 | Phase separation |
| Example 10 | — | — | — | — | Co-continuous | 1.0E+04 | 8 | 100 | 4.0 | Phase separation |
| Example 11 | — | — | — | — | Co-continuous | 1.0E+07 | 8 | 100 | 4.0 | Phase separation |
| Example 12 | — | — | — | — | Co-continuous | 1.0E+04 | 3 | 10 | 2.0 | Phase separation |
| Example 13 | — | — | — | — | Co-continuous | 1.0E+07 | 3 | 10 | 2.0 | Phase separation |
| Example 14 | — | — | — | — | Co-continuous | 1.0E+04 | 8 | 10 | 2.0 | Phase separation |

TABLE 9-continued

| | Intermediate layer | | | | Surface layer | | | | | |
|---|---|---|---|---|---|---|---|---|---|---|
| | State of pore | Volume resistivity (Ω · cm) | Porosity (%) | Thickness (μm) | State of pore | Volume resistivity (Ω · cm) | Average diameter of maximum inscribed circle of opening of pore (μm) | Thickness (μm) | Arithmetic average of circularity K | Production method |
| Example 15 | — | — | — | — | Co-continuous | 1.0E+07 | 8 | 10 | 2.0 | Phase separation |
| Example 16 | — | — | — | — | Co-continuous | 1.0E+04 | 8 | 10 | 1.6 | Phase separation |
| Example 17 | — | — | — | — | Co-continuous | 1.0E+07 | 8 | 10 | 1.6 | Phase separation |
| Example 18 | Continuous and communicating | 1.0E+16 | 95 | 100 | Co-continuous | 1.0E+04 | 8 | 10 | 2.0 | Emulsion |
| Example 19 | Continuous and communicating | 1.0E+16 | 95 | 100 | Co-continuous | 1.0E+07 | 8 | 10 | 2.0 | Emulsion |
| Example 20 | Continuous and communicating | 1.0E+16 | 95 | 100 | Co-continuous | 1.0E+04 | 8 | 10 | 1.6 | Emulsion |
| Example 21 | Continuous and communicating | 1.0E+16 | 95 | 100 | Co-continuous | 1.0E+07 | 8 | 10 | 1.6 | Emulsion |
| Example 22 | — | — | — | — | Co-continuous | 1.0E+04 | 8 | 10 | 2.0 | Emulsion |
| Example 23 | — | — | — | — | Co-continuous | 1.0E+07 | 8 | 10 | 2.0 | Emulsion |
| Example 24 | — | — | — | — | Co-continuous | 1.0E+04 | 8 | 10 | 1.6 | Emulsion |
| Example 25 | — | — | — | — | Co-continuous | 1.0E+07 | 8 | 10 | 1.6 | Emulsion |
| Example 26 | Continuous and communicating | 1.0E+16 | 95 | 100 | Co-continuous | 1.0E+04 | 3 | 3 | 4.0 | Phase separation |
| Example 27 | Continuous and communicating | 1.0E+16 | 95 | 100 | Co-continuous | 1.0E+07 | 3 | 3 | 4.0 | Phase separation |
| Example 28 | — | — | — | — | Co-continuous | 1.0E+04 | 3 | 3 | 4.0 | Phase separation |
| Example 29 | — | — | — | — | Co-continuous | 1.0E+07 | 3 | 3 | 4.0 | Phase separation |
| Example 30 | — | — | — | — | Co-continuous | 1.0E+04 | 8 | 3 | 4.0 | Phase separation |
| Example 31 | — | — | — | — | Co-continuous | 1.0E+04 | 3 | 10 | 2.0 | Phase separation |
| Example 32 | — | — | — | — | Co-continuous | 9.9E+09 | 3 | 10 | 2.0 | Phase separation |
| Example 33 | — | — | — | — | Co-continuous | 1.0E+06 | 3 | 10 | 2.0 | Phase separation |
| Example 34 | — | — | — | — | Co-continuous | 1.0E+07 | 5 | 10 | 2.0 | Phase separation |
| Example 35 | — | — | — | — | Co-continuous | 1.0E+03 | 3 | 10 | 2.0 | Phase separation |
| Example 36 | — | — | — | — | Co-continuous | 1.0E+07 | 3 | 10 | 2.0 | Phase separation |
| Example 37 | — | — | — | — | Co-continuous | 1.0E+07 | 3 | 10 | 2.0 | Phase separation |
| Example 38 | Continuous and communicating | 1.0E+16 | 95 | 100 | Co-continuous | 1.0E+04 | 3 | 3 | 4.0 | Phase separation |
| Example 39 | Continuous and communicating | 1.0E+16 | 95 | 100 | Co-continuous | 1.0E+04 | 3 | 3 | 4.0 | Phase separation |
| Example 40 | Continuous and communicating | 1.0E+16 | 95 | 100 | Co-continuous | 1.0E+04 | 3 | 3 | 4.0 | Phase separation |
| Comparative Example 1 | — | — | — | — | Closed | 1.0E+04 | 20 | 100 | 1.2 | Baloon |
| Comparative Example 2 | — | — | — | — | Co-continuous | 1.0E+04 | 20 | 100 | 3.5 | Phase separation |

TABLE 10

| | Evaluation | | |
|---|---|---|---|
| | Image unevenness | Shaving | Tape colored density |
| Example 1 | A | B | 0.67 |
| Example 2 | A | B | 0.83 |
| Example 3 | A | B | 0.73 |
| Example 4 | A | B | 0.80 |
| Example 5 | A | B | 0.87 |
| Example 6 | A | B | 0.84 |
| Example 7 | B | B | 1.06 |
| Example 8 | B | B | 1.10 |
| Example 9 | B | B | 1.38 |
| Example 10 | B | B | 1.10 |
| Example 11 | B | B | 1.38 |
| Example 12 | B | B | 1.06 |
| Example 13 | B | B | 1.32 |
| Example 14 | B | B | 1.06 |
| Example 15 | B | B | 1.32 |
| Example 16 | B | B | 1.17 |
| Example 17 | B | B | 1.47 |
| Example 18 | A | B | 0.76 |
| Example 19 | A | B | 0.95 |

TABLE 10-continued

| | Evaluation | | |
|---|---|---|---|
| | Image unevenness | Shaving | Tape colored density |
| Example 20 | A | B | 0.84 |
| Example 21 | B | B | 1.06 |
| Example 22 | B | B | 1.06 |
| Example 23 | B | B | 1.32 |
| Example 24 | B | B | 1.17 |
| Example 25 | B | B | 1.47 |
| Example 26 | A | B | 0.60 |
| Example 27 | A | B | 0.76 |
| Example 28 | A | B | 0.80 |
| Example 29 | B | B | 1.00 |
| Example 30 | A | B | 0.80 |
| Example 31 | A | B | 0.96 |
| Example 32 | C | B | 1.60 |
| Example 33 | B | B | 1.07 |
| Example 34 | B | B | 1.20 |
| Example 35 | A | B | 0.87 |
| Example 36 | B | B | 1.20 |
| Example 37 | B | B | 1.20 |
| Example 38 | A | A | 0.67 |

TABLE 10-continued

| | Evaluation | | |
|---|---|---|---|
| | Image unevenness | Shaving | Tape colored density |
| Example 39 | A | A | 0.80 |
| Example 40 | A | A | 0.67 |
| Comparative Example 1 | D | B | 2.50 |
| Comparative Example 2 | D | B | 2.13 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-202664, filed on Sep. 27, 2013, the content of which is incorporated herein by reference.

What is claimed is:

1. An electroconductive member for electrophotography, comprising at least:

an electroconductive support; and a surface layer formed on an outer side of the electroconductive support, wherein the surface layer comprises a porous body, and wherein the porous body satisfies the following conditions (1) to (3):

(1) the porous body has a co-continuous structure including at least a skeleton that is three-dimensionally continuous and a pore that is three-dimensionally continuous;

(2) the porous body has an electroconductivity; and (3) an average diameter of a maximum inscribed circle of an opening of the pore on a surface of the porous body is 3 μm or more and 8 μm or less.

2. An electroconductive member for electrophotography according to claim 1, wherein the opening of the pore has an arithmetic average of a circularity K of 2.0 or more, the circularity K being determined by $L^2/4\pi S$, where L represents a perimeter of the opening of the pore, and S represents an area of the opening of the pore.

3. An electroconductive member for electrophotography according to claim 1, wherein the porous body is formed by phase separation between a polymer material and a solvent.

4. An electroconductive member for electrophotography according to claim 1, further comprising, between the electroconductive support and the surface layer, an intermediate layer that satisfies the following conditions (4) to (8):

(4) the intermediate layer comprises a porous body including a pore that is continuous from an interface between the electroconductive support and the intermediate layer to an interface between the surface layer and the intermediate layer;

(5) an opening of the pore in the intermediate layer and the opening of the pore in the surface layer communicate to each other at the interface between the intermediate layer and the surface layer;

(6) the intermediate layer has a volume resistivity of $1\times10^{10}$ Ω·cm or more and $1\times10^{16}$ Ω·cm or less;

(7) the intermediate layer has a porosity of 40% or more and 95% or less; and (8) the intermediate layer has a thickness of 3 μm or more and 100 μm or less.

5. An electroconductive member for electrophotography according to claim 1, further comprising a rigid structure configured to protect the porous body.

6. A process cartridge configured to be removably mounted onto a main body of an electrophotographic apparatus, the process cartridge comprising the electroconductive member for electrophotography according to claim 1.

7. An electrophotographic apparatus, comprising the electroconductive member for electrophotography according to claim 1.

* * * * *